US005263416A

United States Patent [19]

Amundson et al.

[11] Patent Number: 5,263,416

[45] Date of Patent: Nov. 23, 1993

[54] PRIMER PROPELLANT ELECTRICAL IGNITION INTERCONNECT ARRANGEMENT FOR SINGLE AND MULTIPLE PIECE AMMUNITION

[75] Inventors: Mark D. Amundson, Cambridge; James L. Kennedy, Bloomington, both of Minn.

[73] Assignee: Alliant Techsystems Inc., Edina, Minn.

[21] Appl. No.: 832,066

[22] Filed: Feb. 6, 1992

[51] Int. Cl.[5] ..... F42B 5/16; F42B 3/10

[52] U.S. Cl. ..... 102/202.9; 102/202.7; 102/472; 102/443; 102/217

[58] Field of Search ..... 102/202.9, 202.11, 202.13, 102/202.14, 470, 472, 275.11, 430, 443, 202.5, 202.7, 202.8, 202, 217, 308

[56] References Cited

U.S. PATENT DOCUMENTS

| | | | |
|---|---|---|---|
| 605,842 | 6/1898 | Bates | 102/430 |
| 2,824,496 | 2/1958 | Kullev et al. | 102/217 |
| 3,728,967 | 4/1973 | Hinkle et al. | 102/202.8 |
| 3,759,183 | 9/1973 | Apstein | 102/202.5 |
| 4,619,202 | 10/1986 | Romer et al. | 102/470 |
| 4,630,539 | 12/1986 | Thorn et al. | 102/202 |
| 5,140,906 | 8/1992 | Little, II | 102/202.14 |

FOREIGN PATENT DOCUMENTS

| | | | |
|---|---|---|---|
| 47212 | 6/1900 | Fed. Rep. of Germany | 102/472 |
| 826891 | 1/1960 | United Kingdom | 102/202.5 |

*Primary Examiner*—Stephen M. Johnson
*Attorney, Agent, or Firm*—Haugen and Nikolai

[57] ABSTRACT

A multi-piece ammunition round includes an aft cartridge, a forward cartridge, and a projectile disposed in an end-to-end nested, serial arrangement. The aft and forward cartridges each contain a charge of propellant. The projectile contains a high explosive filler and a projectile fuze. The round also includes a propellant-primer electrical ignition interconnect arrangement associated with the aft and forward cartridges. The ignition interconnect arrangement includes a multi-element primer disposed in a base of the aft cartridge for contact by a firing mechanism of a gun system and communicating with the propellant charge contained in the aft cartridge, an electrical interconnect interface disposed between the aft and forward cartridges, an electro-explosive device disposed in the propellant charge contained in the forward cartridge, a first plurality of insulated electrical conductors disposed in the aft cartridge and electrically connecting the primer with the electrical interconnect interface, and a second plurality of insulated electrical conductors disposed in the forward cartridge and electrically connecting the interconnect interface with the electro-explosive device.

30 Claims, 5 Drawing Sheets

PRIMER PROPELLANT ELECTRICAL IGNITION INTERCONNECT ARRANGEMENT FOR SINGLE AND MULTIPLE PIECE AMMUNITION

BACKGROUND OF THE INVENTION

1. Field of the Invention

The present invention generally relates to large caliber projectile ammunition and, more particularly, to a primer-propellant electrical ignition interconnect arrangement for both single and multiple piece ammunition.

2. Description of the Prior Art

The evolution of large caliber ordnance has led to the development of ammunition with increased lethality and correspondingly to weapon systems with increased armor protection in defense. As larger calibers of guns and projectiles have been developed, propulsion-ignition systems have grown in size and in energy content to give progressively higher projectile velocities and in-bore pressures. The pressure effects of violently exploding propellant create pressure shock waves which, if not properly controlled, can inflict damage to the projectile prior to its expulsion from the gun muzzle.

Presently, some large caliber ordnance has outstripped the capability of soldiers to lift an entire round into the gun breech. This has led to the design of multiple piece ammunition in which the first loaded piece contains the projectile and successive piece(s) contain additional propellant. As with most ammunition, the last piece contains the propellant igniter, or primer.

With the current single and multiple piece ammunition, only one ignition point exists to propagate the explosive combustion of the propellant throughout the cartridge or container. In large caliber gun systems, the propulsion system propagation time may be too slow to provide maximum efficiency of energy provided by the burning propellant. Many pyrotechnic schemes have been devised to accelerate the combustion of propellant with moderate success.

In multiple piece ammunition, the primary inhibitor to rapid combustion of cartridge propellants is the interface between separate cartridge pieces. Modern multiple piece ammunition trades off the rapidity of pyrotechnic propagation devices for rugged but combustible cartridge cases. Since most large caliber ignition devices are electrically activated by hot wire, or bridge wire devices, the approach of placing one of these electro-explosive devices per cartridge has been tried but with little success.

The lack of success experienced with using multiple electro-explosive devices derives from the bridge wire's unpredictable initiation time. Typically, the wire's ability to initiate explosive materials varies by as much as a few milliseconds. With propellant combustion times of ten milliseconds or less for most ammunition, the cartridge-to-cartridge ignition times create enormous pressure shock waves which tend to break projectile stabilization fins and like projectile and gun system parts.

Consequently, a need exists for an effective arrangement to more precisely control electro-explosive device ignition times so as to overcome the problems experienced heretofore.

SUMMARY OF THE INVENTION

The present invention provides a propellant-primer electrical ignition interconnect arrangement designed to satisfy the aforementioned need. The electrical ignition interconnect arrangement of the present invention overcomes the problems described above by using dedicated wiring and fast-acting electro-explosive devices in conjunction with several unique cartridge-to-cartridge electrical interconnections.

Accordingly, the present invention is directed to a primer-propellant electrical ignition interconnect arrangement in a multi-piece ammunition round. The multi-piece ammunition round includes an elongated aft cartridge having a rear base and a forward open end, an elongated forward cartridge having a rear base and a forward open end, and a projectile. The aft and forward cartridges and the projectile are disposed in a tandem, end-to-end nested, serial arrangement. Each of the aft and forward cartridges contains a charge of propellant.

The electrical ignition interconnect arrangement comprises: (a) a multi-element primer disposed in the rear base of the aft cartridge for contact by a firing mechanism of a gun system, the primer communicating with the propellant charge contained in the aft cartridge; (b) an electrical interconnect interface disposed between the aft and forward cartridges; (c) an electro-explosive device disposed in the propellant charge contained in the forward cartridge; (d) first means disposed in the aft cartridge for electrically connecting the primer with the electrical interconnect interface; and (e) second means disposed in the forward cartridge for electrically connecting the interconnect interface with the electro-explosive device in the forward cartridge.

The multi-element primer includes at least two radially-spaced inner and outer concentric electrodes, a hollow primer housing surrounding and spaced outwardly from the electrodes and having a plurality of apertures providing communication between the interior of the housing and the propellant charge contained in the aft cartridge, and an annular electrical insulating member disposed between the inner and outer electrodes and disposed between the outer electrode and the primer housing. The multi-element primer also includes a second electro-explosive device disposed in the hollow primer housing and connected to the inner electrode, and an explosive charge contained in the hollow primer housing between the second electro-explosive device and the housing apertures.

The first connecting means includes a first insulated electrical conductor in the aft cartridge connected at one end to the outer electrode of the primer and at a opposite end to the electrical interconnect interface disposed between the aft and forward cartridges, and a second insulated electrical conductor in the aft cartridge connected at one end to the rear base of the aft cartridge and the electrical interconnect interface disposed between the aft and forward cartridges.

The electrical interconnect interface disposed between the aft and forward cartridge includes a first transverse wall member disposed across the forward open end of the aft cartridge and having a pair of opposite first and second sides, and a second transverse wall member disposed across the rear base of the forward cartridge and having a pair of opposite first and second sides. The second sides of the respective first and second transverse wall members are disposed adjacent to and face toward one another and are disposed in axially spaced relation to one another. Also, the electrical interconnect interface includes first and second electrical contact elements disposed on each of the second sides of the respective first and second wall members. The first and second contact elements on the second side of the first wall member is electrically engaged with the corresponding first and second electrical contact elements on the second side of the second wall member. Further, the electrical interconnect interface includes means for electrically interconnecting the first and second contact elements on the respective second sides of the first and second wall members through the respective first and second wall members to the respective first and second pluralities of insulated electrical conductors disposed in the aft and forward cartridges. The interconnecting means is a plurality of electrically conductive rivets fastened through each of the first and second tranverse wall members.

In one embodiment, the first and second electrical contact elements on the second sides of the respective first and second transverse wall members are strips of conductive complementary hook and loop material being detachably attachable together. In another embodiment, the first and second electrical contact elements are strips of aluminum foil. Also, a yieldably resilient material is provided to back the aluminum foil strips of the first and second electrical contact elements on the second side of one of the first and second transverse wall members.

These and other features and advantages of the present invention will become more apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, wherein like reference numerals refer to like parts, reference will be made to the attached drawings in which.

DETAILED DESCRIPTION OF THE PREFERRED EMBODIMENTS

Figure 1:
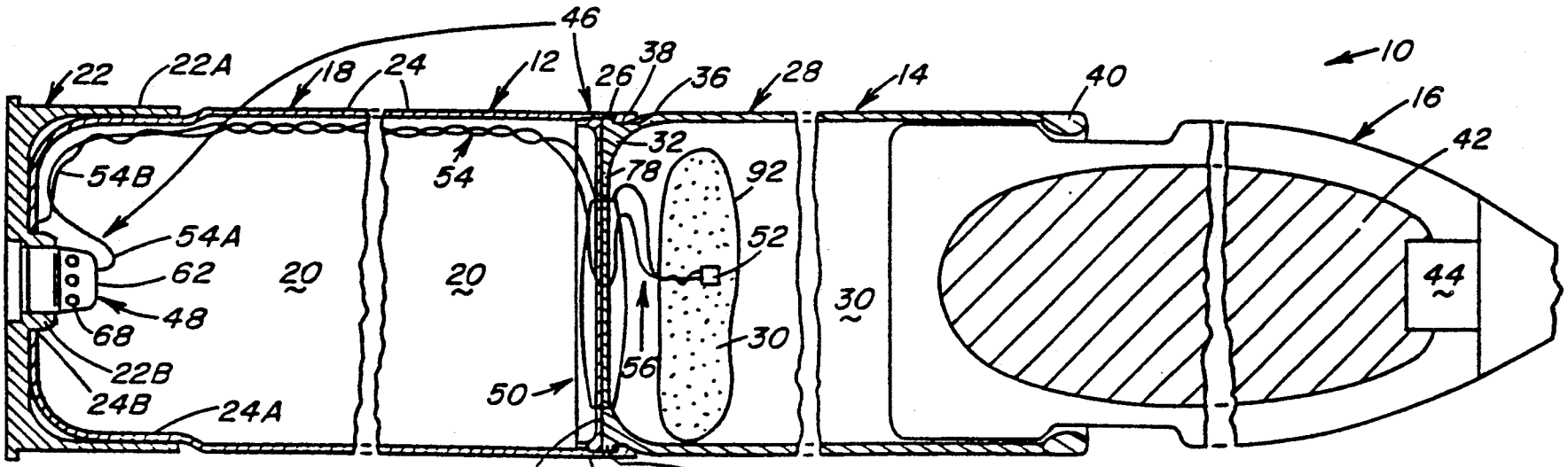
FIG. 1 is a foreshortened longitudinal sectional view of a large caliber two-piece round of ammunition incorporating an electrical ignition interconnect arrangement of the present invention.
Figure 3:
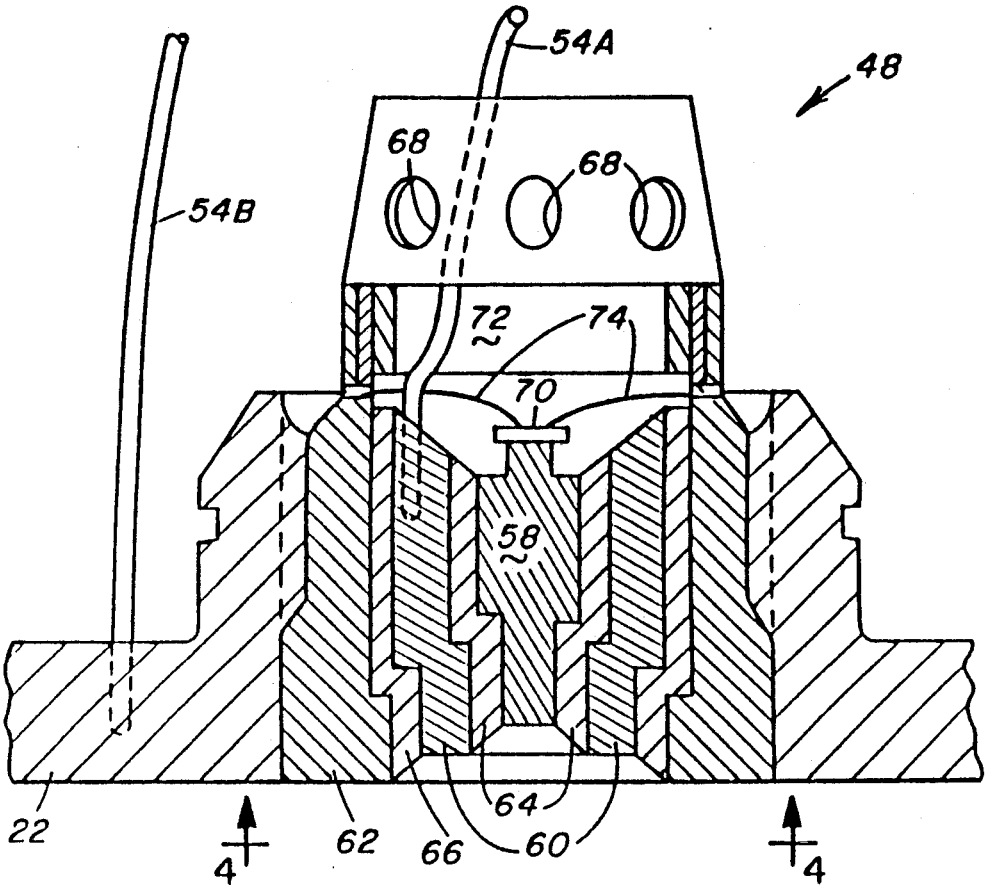
FIG. 3 is an enlarged fragmentary longitudinal sectional view of a base of the ammunition round of FIG. 1, illustrating a multi-element primer employed by the electrical ignition interconnect arrangement of the present invention.
Figure 4:
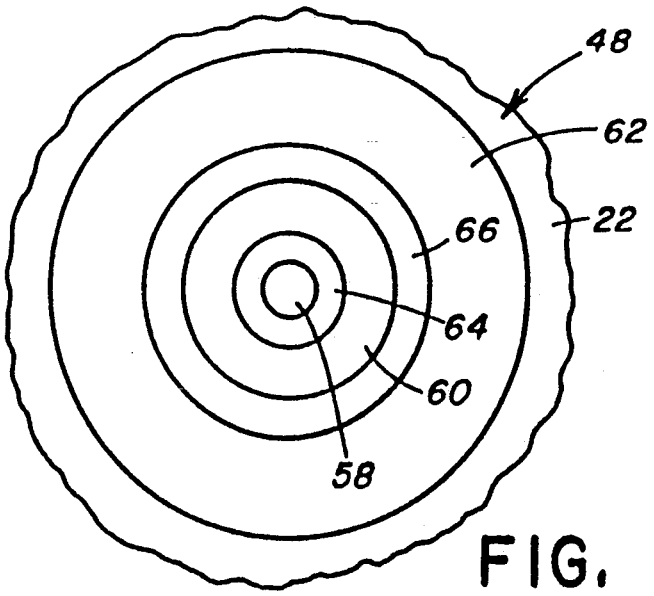
FIG. 4 is an end elevational view of the multiple element primer as seen along line 4—4 of FIG. 3.

Referring now to the drawings, and particularly to FIG. 1, there is illustrated a multi-piece ammunition round, generally designated 10, which can be fired by a large caliber gun system. The multi-piece ammunition round 10 includes an aft cartridge 12, a forward cartridge 14, and a projectile 16 disposed in an end-to-end nested, serial arrangement.

The aft cartridge 12 includes an elongated cup-shaped cylindrical case 18 which contain a charge of propellant 20. The case 18 includes a separate cup-shaped aft end base 22 and an elongated cylindrical sidewall 24 of combustible material, such as nitrocellulose or other suitable propellant containment materials which will be consumed during firing of the round 10. The aft end base 22 of the case 18 has an outer cylindrical sidewall 22A and an inner annular collar 22B. The combustible sidewall 24 of the case 18 has a cup-shaped rear end portion 24A of reduced outside diameter and with a central opening 24B to permit mating within the outer sidewall 22A and over the annular collar 22B of the aft end base 22. The sidewall 24 of the case 18 has a forward open end 24C with an annular recess 26 defined around the interior thereof.

The forward cartridge 14 includes an elongated cup-shaped cylindrical case 28 which contain a charge of propellant 30. The case 28 includes an integrally-connected cup-shaped aft base 32 and an elongated cylindrical combustible sidewall 34. The aft base 32 of the case 28 has an annular exterior groove 36 mated with an annular interior shoulder 38 defined on the forward end 24C of the combustible sidewall 24 of the aft cartridge case 18. The aft base 32 of the case 28 also has an exterior annular rim 32A mated within the annular internal recess 26 in the forward end 24C of the combustible sidewall 24 of the aft cartridge case 18. The forward end of the combustible sidewall 34 of the forward cartridge case 28 has a rotating annular band 40 which receives and holds the projectile 16 therein. The projectile 16 contains a high explosive filler 42 and a projectile fuze 44.

Referring to FIGS. 1–4, the multi-piece ammunition round 10 also includes an electrical ignition interconnect arrangement 46 of the present invention being associated with the aft and forward cartridges 12, 14. The ignition interconnect arrangement 46 basically includes a multi-element primer 48, an electrical interconnect interface 50, a first electro-explosive device 52, a first plurality of insulated electrical conductors 54 electrically connecting the primer 48 with the interconnect interface 50, and a second plurality of insulated electrical conductors 56 electrically connecting the interconnect interface 50 with the first electro-explosive device 52. The conductors 54 run along the interior of the sidewall 34 of the aft cartridge case 28. The first electro-explosive device 52 is preferably a semiconductor bridge type.

The multi-element primer 48 includes at least two radially-spaced inner and outer concentric electrodes 58, 60, a hollow primer housing 62, and inner and outer annular electrical insulating members 64, 66. The hollow housing 62 surrounds and is spaced outwardly from the electrodes 58, 60. The hollow housing 62 at its forward end has a plurality of apertures 68 which permit explosive train propagation or communication from the interior of the housing 62 to the propellant charge 20 contained in the aft cartridge 12. The hollow housing 62 at its rear end is threadably mounted to the end base 22 of the aft cartridge case 18 which provides a common ground to the primer housing 62. The inner annular electrical insulating member 64 is disposed between the inner and outer electrodes 58, 60. The outer annular electrical insulating member 66 is disposed between the outer electrode 60 and the primer housing 62.

Figure 5:
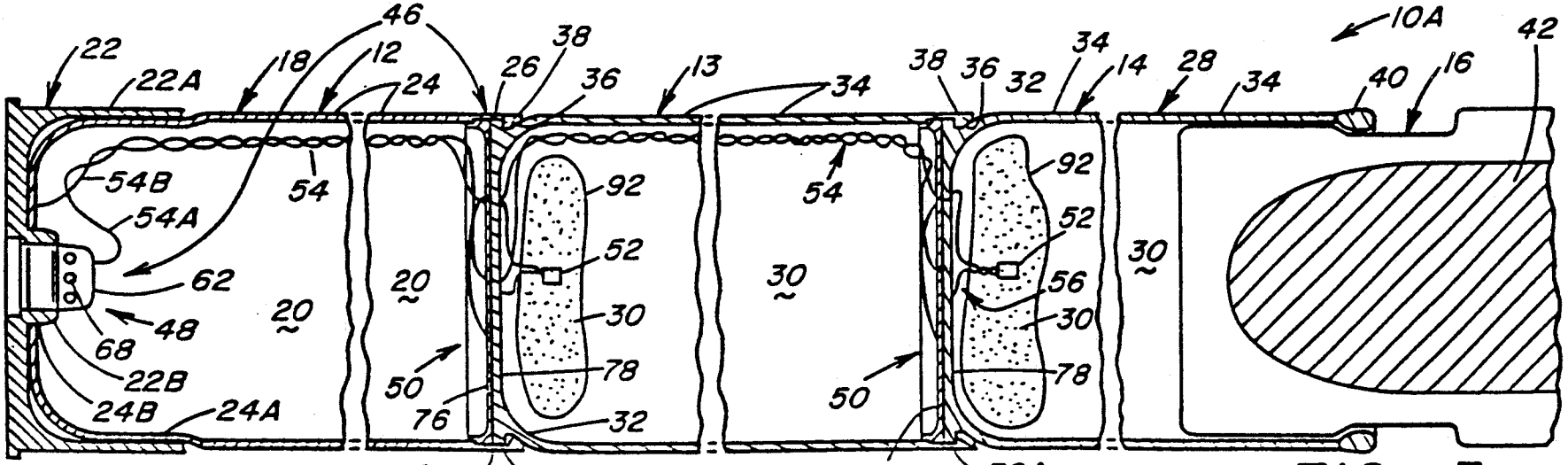
FIG. 5 is a foreshortened longitudinal sectional view of a large caliber three-piece round of ammunition incorporating the electrical ignition interconnect arrangement of the present invention.

The primer housing 62 thus supports the concentrically placed inner and outer insulating members 64, 66 and inner and outer electrodes 58, 60 so as to prevent the combustion gases from escaping through the primer 48. The inner and outer electrodes 58, 60 with the casing base 22 also provide the electrical contacts for the gun system's firing circuits. The outer electrode 60 is bonded to a first insulated electrical conductor 54A of the first plurality 54 thereof to provide an electrical supply path for secondary ignition currents to the succeeding forward cartridge 14 of FIG. 1 or cartridges 14, 14A of FIG. 5. The metal aft base 22 is bonded to a second insulated electrical conductor 54B of the first plurality 54 thereof to provide an electical return path.

The multi-element primer 48 also includes a second electro-explosive device 70, also preferably of the semiconductor bridge type, disposed in the hollow primer housing 62 and connected, such as mechanically bonded, to the inner electrode 58. Also, an explosive charge 72 is contained in the hollow primer housing 62 between the second electro-explosive device 70 and the housing apertures 68. One electrical contact of the electro-explosive device 70 is electrically connected to the inner electrode 58, whereas the other contact is electrically connected by wires 74 to the primer housing 62. Use of semiconductor bridge type devices for the first and second electro-explosive devices 52, 72 permits simultaneous ignition of the devices to within hundredths of a millisecond or controlled ignition for gradual pressure rise.

Figure 2:
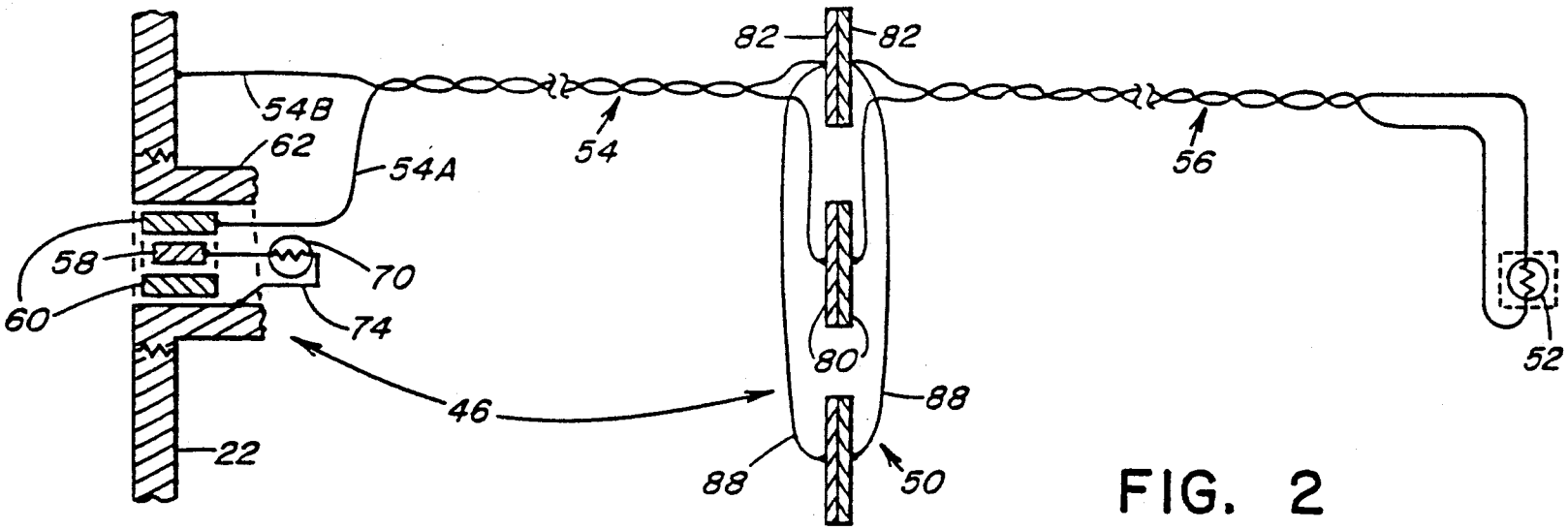
FIG. 2 is a schematic diagram representing the corresponding electrical ignition interconnect arrangement of FIG. 1.
Figure 6:
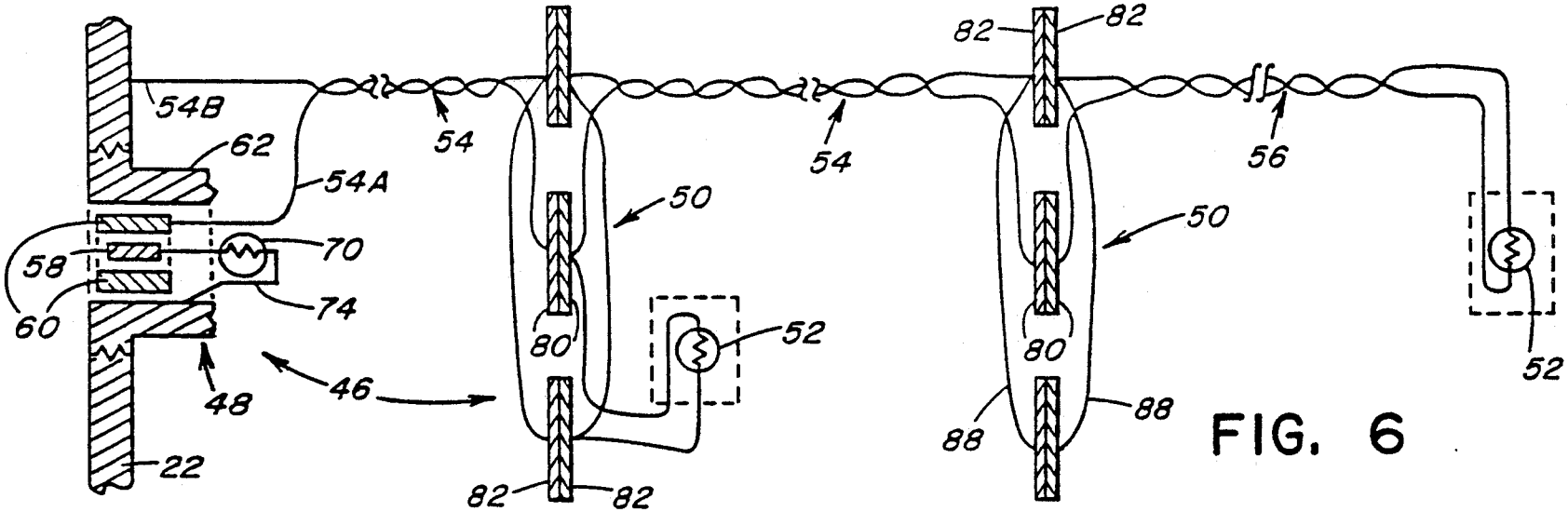
FIG. 6 is a schematic diagram representing the corresponding electrical ignition interconnect arrangement of FIG. 5.

Referring again to the two-piece ammunition round 10 of FIGS. 1 and 2, the electrical interconnect interface 50 is disposed between the aft and forward cartridges 12, 14. In the three-piece ammunition round 10A of FIGS. 5 and 6, identical electrical interconnect interfaces 50 are disposed between the aft and intermediate cartridges 12, 13 and between the intermediate and forward cartridges 13, 14. In both cases, the electrical interconnect interface 50 includes a first transverse wall member 76 disposed across the forward open end 24C of the aft cartridge case sidewall 24 and having a pair of opposite first and second sides 76A, 76B, and a second transverse wall member 78 disposed across the rear base 32 of the forward cartridge case 28 and having a pair of opposite first and second sides 78A, 78B. The second sides 76B, 78B of the respective first and second transverse wall members 76, 78 are disposed adjacent to and face toward one another and are disposed in axially spaced relation to one another. The first transverse wall member 76 is fitted across the forward open end 24C of the aft cartridge 12 by being mated within the annular internal recess 26 defined in the forward end 24C of the combustible sidewall 24 of the case 18. The second transverse wall member 78 is part of the base 32 of the forward cartridge case 28.

Also, the electrical interconnect interface 50 includes first and second electrical contact elements 80, 82 disposed on each of the second sides 76B, 78B of the respective first and second wall members 76, 78. The first and second electrical contact elements 80, 82 are in the form of a central contact element 80 and an annular contact element 82 surrounding and spaced outwardly from the central contact element 80. The first and second contact elements 80, 82 on the second side 76B of the first wall member 76 is electrically engaged with the corresponding first and second electrical contact elements 80, 82 on the second side 78B of the second wall member 78.

Further, the electrical interconnect interface 50 includes means in the form of electrically conductive rivets 84 extending through the first and second wall members 76, 78. The rivets 84 and terminals 86 on the ends of the insulated electrical conductors 54, 56 in the aft and forward cartridges 12, 14 (and also in the intermediate cartridges 13) electrically interconnect the first and second contact elements 80, 82 on the respective facing second sides 76B, 78B of the first and second wall members 76, 78 through the respective first and second wall members 76, 78 to the respective first and second pluralities of electrical conductors 54, 56. Also, short insulated conductors 88 and terminals 90 are provided for interconnecting the heads of the rivets 84 located on the first sides 76A, 78B of the first and second wall members 76, 78. In such manner the first and second pluralities of insulated conductors 54, 56, first and second contact elements 80, 82, rivets 84 and terminals 86 provide supply and return paths for passing ignition currents from the primer 48 to the electrical interconnect interface(s) 50 and therefrom to the first electro-explosive device(s) 52 residing in a powder bag 92 in the forward cartridge 14 (and any intermediate cartridge 13). The second plurality of insulated conductors 56 pass the ignition currents to the first electro-explosive device 52.

Figure 8:
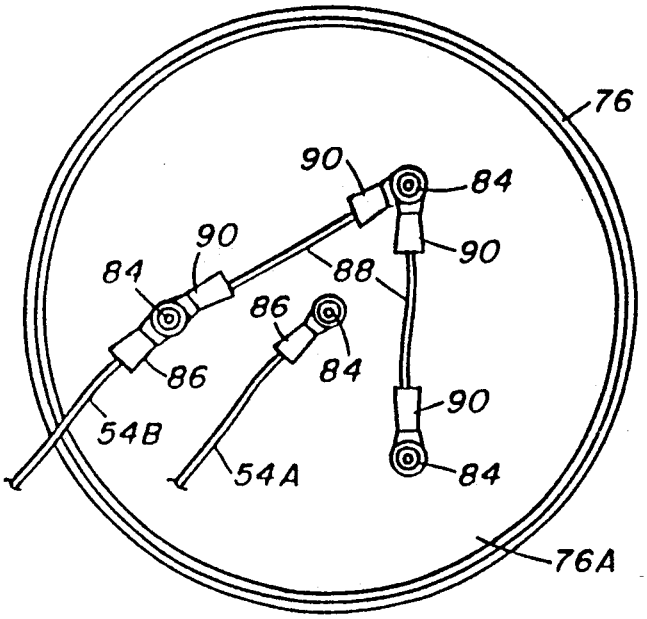
FIG. 8 is an end elevational outside view, on a reduced scale, of the electrical interconnect interface as seen along line 8—8 of FIG. 7.
Figure 7:
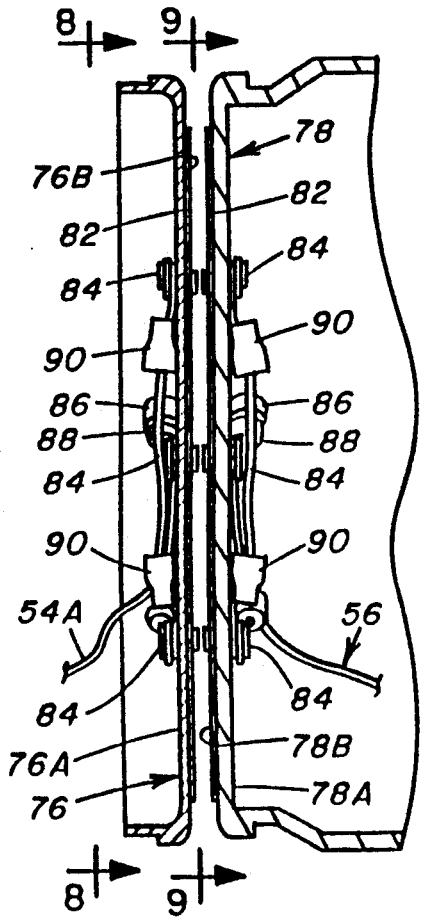
FIG. 7 is an enlarged fragmentary longitudinal sectional view of the multiple piece round of ammunition of either FIG. 1 or FIG. 5, illustrating an electrical interconnect interface employing conductive strips of matable hook and loop materials providing mechanical and electrical connections between the multiple pieces of the ammunition round.
Figure 9:
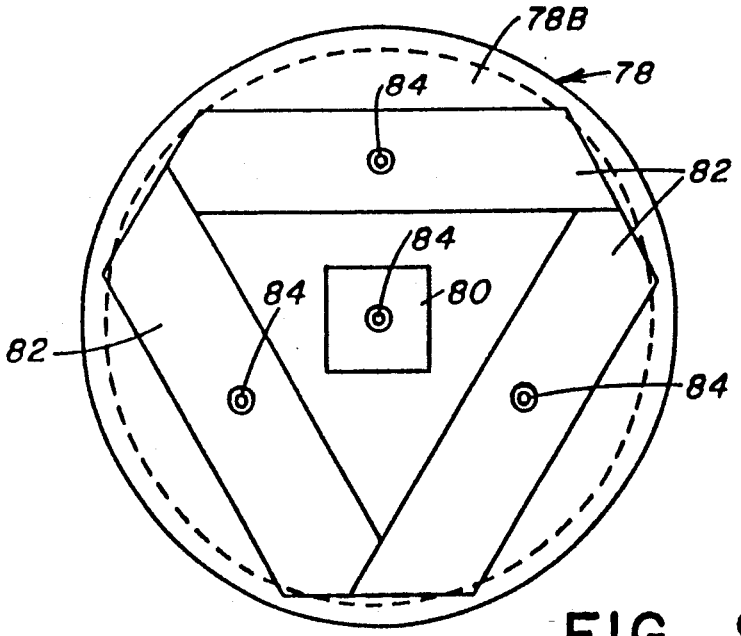
FIG. 9 is an end elevational inside view, on a reduced scale, of the electrical interconnect interface as seen along line 9—9 of FIG. 7.

Referring to FIGS. 7–9, there is illustrated a first embodiment of the first and second electrical contact elements 80, 82 on the second sides 76B, 78B of each of the respective first and second transverse wall members 76, 78. The first and second contact elements 80, 82 are strips of conductive strips of complementary matable hook and loop material 80A, 80B and 82A, 82B adhesively attached on the wall members 76, 78 and being detachably attachable together and providing mechanical and electrical connections between the multiple pieces of the ammunition round. The strips of the second or outer contact element 82 are arranged in a triangular shape which surrounds the strip of the first or inner central contact element 80.

Figure 11:
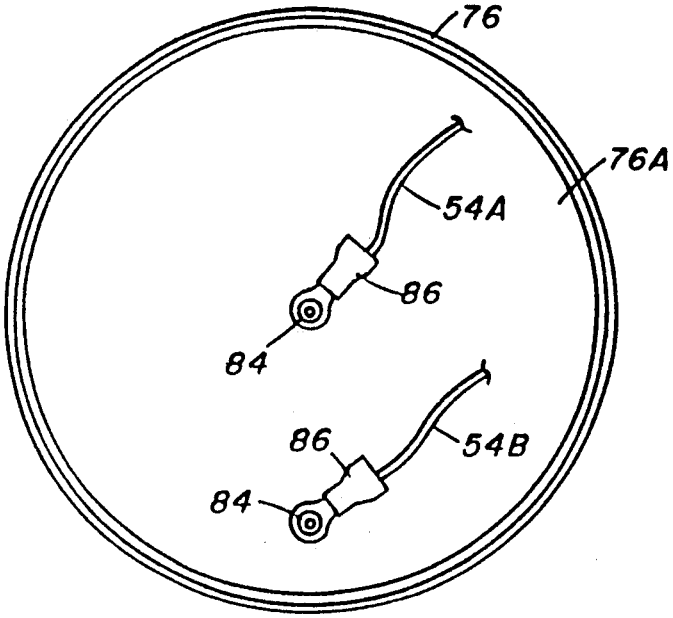
FIG. 11 is an end elevational outside view, on a reduced scale, of the electrical interconnect interface as seen along line 11—11 of FIG. 10.
Figure 10:
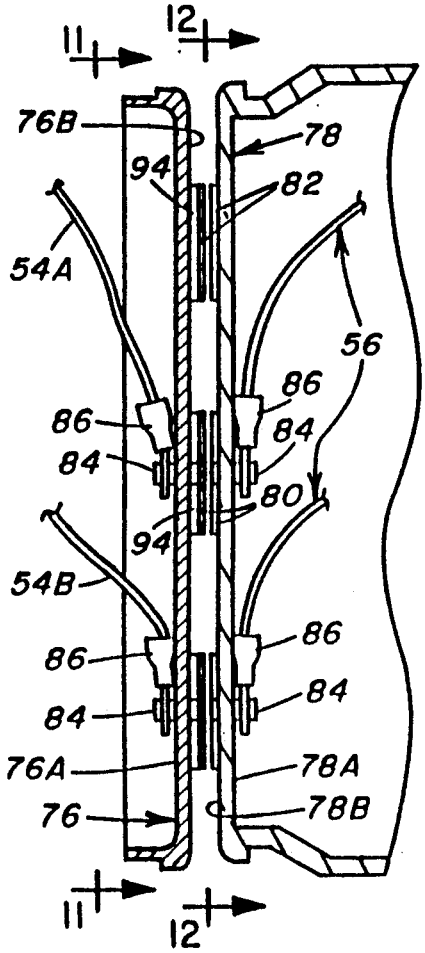
FIG. 10 is an enlarged fragmentary longitudinal sectional view of a multiple piece round of ammunition of FIG. 1 or FIG. 5, illustrating an electrical interconnect interface employing strips of aluminum foil adhered to a yieldable backing material for providing a compressible electrical connection.
Figure 12:
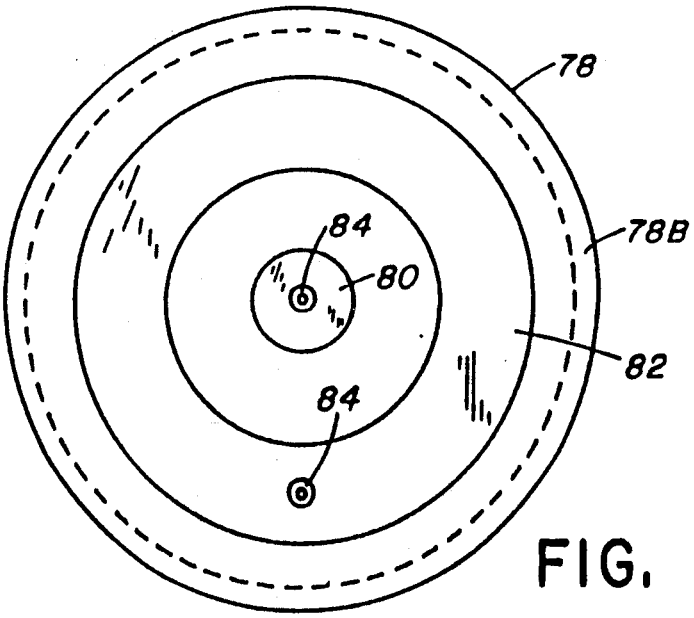
FIG. 12 is an end elevational inside view, on a reduced scale, of the electrical interconnect interface as seen along line 12—12 of FIG. 10.

Referring to FIGS. 10–12, there is illustrated second embodiment of the first and second electrical contact elements 80, 82 on the second sides 76B, 78B of each of the respective first and second transverse wall members 76, 78. The first and second contact elements 80, 82 are strips of aluminum foil adhesively attached on the wall members 76, 78 to provide the inner central contact and outer annular concentric contact. Also, a yieldably resilient material 94, such as foamed rubber or sponge, is provided to back the aluminum foil strips of the first and second electrical contact elements 80, 82 on the second side 76B, 78B of one of the first and second transverse wall members 76, 78 for providing a compressible electrical connection.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A multi-cartridge unit ammunition round including:

an aft cartridge unit having a rear base and forward end;

one or more independent forward cartridge units each having a rear base and a forward end, and a projectile;

wherein the aft and all forward cartridge units and projectile are configured to be disposed in a tandem, end-to-end nested, coaxial arrangement, forming intermediate interfaces therebetween, the assembled aft and independent forward cartridge units further being susceptible of separation and reconnection in a nested, coaxial arrangement, the aft and each forward cartridge unit being further adapted to contain a charge of propellant;

each said intermediate interface including a transverse aft wall member associated with the forward cartridge unit of the interface and a transverse forward end wall associated with the after cartridge unit of the interface disposed in back-to-back arrangement when assembled, the interface therebetween separating the cartridge units;

retaining means for detachably and reconnectably retaining the independent cartridge units together in the tandem, coaxial arrangement;

a propellant-primer electrical ignition interconnect arrangement, comprising, a multi-element primer mounted in the base of the aft cartridge unit adapted to receive external electrical activation energy, and including a plurality of primer electrodes, an aft cartridge unit electro-ignition device for igniting said charge of propellant contained in the aft cartridge unit, a disconnectable/reconnectable electrical interconnect interface associated with each said cartridge unit-to-cartridge unit interface and providing electrical conduction continuity therethrough, an electro-ignition device disposed in each said forward cartridge unit to ignite said charge of propellant contained in each said forward cartridge unit, connecting conductor means disposed in each said forward cartridge unit save an ultimate forward cartridge unit for electrically connecting one of said plurality of primer electrodes in said aft cartridge with a respective electrical interconnect interface associated with each ensuing said forward cartridge unit, and ignition conductor means disposed in each ensuing said forward cartridge unit for electrically connecting the respective interconnect interface with the respective electro-ignition device in each said forward cartridge unit.

2. The multi-cartridge unit ammunition round of claim 1 wherein the retaining means for detachably and reconnectably retaining the independent cartridge units together is readily engaged and disengaged such that the number of intermediate cartridge units can be altered just prior to firing.

3. The multi-cartridge unit ammunition round of claim 1 wherein the retention means for detachably retaining the independent cartridge units in the tandem end-to-end arrangement comprises snap-fitting mating means.

4. The multi-cartridge unit ammunition round of claim 3 wherein the snap-fitting mating means includes an annular exterior groove on one unit mated with an annular interior shoulder on the adjacent unit.

5. The multi-cartridge unit ammunition round of claim 1 wherein the multi-element primer includes:

at least two radially-spaced inner and outer concentric primer electrodes;

a hollow primer housing surrounding and spaced outwardly from the electrodes and having a plurality of apertures providing communication between the interior of the housing and said propellant charge contained in the aft cartridge unit; and annular electrical insulating members disposed between the inner and outer primer electrodes and disposed between the outer electrode and the primer housing.

6. The multi-cartridge unit ammunition round of claim 5 wherein:

the aft cartridge unit electro-ignition device is disposed in the hollow primer housing and connected to the inner electrode; and further comprising an explosive charge contained in the hollow primer housing between the aft cartridge unit electro-ignition device and the apertures in the housing.

7. The multi-cartridge unit ammunition round of claim 5 wherein the connecting conductor means includes:

a first insulated electrical conductor in the aft cartridge unit connected at one end to the outer electrode of the primer and at an opposite end to the electrical interconnect interface disposed between the aft and forward cartridge units; and a second insulated electrical conductor in the aft cartridge unit connected at one end to the base of the aft cartridge unit and at another end to the electrical interconnect interface disposed between the aft and forward cartridge units.

8. The multi-cartridge unit ammunition round of claim 1 wherein each said electrical interconnect includes:

a pair of opposite first and second sides associated with each said transverse forward wall member;

a pair of opposite first and second sides associated with each said transverse aft wall member, the second sides of the respective forward and aft transverse wall members adjacent to and facing toward one another and disposed in axially spaced relation to one another;

first and second electrical contact elements disposed on each of the second sides of the respective forward and aft wall members, the first and second electrical contact elements on the second sides of the forward wall member being electrically engaged with the corresponding first and second electrical contact elements on the second side of the aft wall member; and means for electrically interconnecting the first and second electrical contact elements on the respective second sides of the forward and aft wall members through the respective forward and aft wall members to the respective first and second pluralities of insulated electrical conductors disposed in the aft and forward cartridge units.

9. The multi-cartridge unit ammunition round of claim 8 wherein the first and second electrical contact elements on each of the second sides of the forward and aft transverse wall members includes:

a central contact element; and an annular contact element surrounding and spaced outwardly from the central contact element.

10. The multi-cartridge unit ammunition round of claim 9 wherein the interconnecting means includes a plurality of electrically conductive rivets fastened through each of the forward and aft transverse wall members.

11. The multi-cartridge unit ammunition round of claim 8 wherein the first and second electrical contact elements on the second sides of the respective forward and aft transverse wall members are strips of conductive complementary material being detachably attachable together.

12. The multi-cartridge unit ammunition round of claim 8 wherein the first and second electrical contact elements on the second sides of the respective forward and aft transverse wall members are strips of aluminum foil.

13. The multi-cartridge unit ammunition round of claim 12 wherein the electrical interconnect interface also includes yieldably resilient material backing the aluminum foil strips of the first and second electrical contact elements on the second side of one of the first and second transverse wall members.

14. A multi-cartridge unit ammunition round including:

an aft cartridge unit having a rear base and forward end;

at least a first forward cartridge unit each having a rear base and a forward end, and a projectile;

wherein the aft and forward cartridge units and projectile are configured to be disposed in a tandem, end-to-end nested, serial arrangement, the aft and forward cartridge units each containing a charge of propellant;

a propellant-primer electrical ignition interconnect arrangement, comprising, a multi-element primer system mounted in the base of the aft cartridge unit adapted to receive external electrical activation energy, the primer system having a plurality of primer electrodes, the aft cartridge unit further comprising an electro-ignition device electrically connected to one of said plurality of primer electrodes and communicating with the propellant charge contained in the aft cartridge unit, one or more electrical interconnect interfaces including back-to-back transverse wall members, one of said electrical interconnect interfaces associated with and separating the aft and the first forward cartridge unit and additional ones of said electrical interconnect interfaces separating each of any successive additional forward cartridge units each providing electrical conduction continuity therethrough, one or more additional electro-ignition devices, one of which is disposed in the propellant charge contained in each said forward cartridge unit, one or more first sets of insulated electrical conductors each electrically connecting a primer electrode of said plurality of primer electrode with a corresponding one of said one or more electrical interconnect interfaces; and one or more second sets of insulated electrical conductors each electrically connecting an interconnect interface of said at least one interconnect interface with a corresponding one of said one or more electro-ignition devices.

15. The multi-cartridge unit ammunition round of claim 14 wherein the transverse wall members are combustible.

16. The multi-cartridge unit ammunition round of claim 15 wherein the electrical interconnect interface includes:

a first transverse wall member forming the forward end of the aft cartridge unit and having a pair of opposite first and second sides;

a second transverse wall member forming the rear base of the forward cartridge unit and having a pair of opposite first and second sides, the second sides of the respective first and second transverse wall members adjacent to and facing toward one another and disposed in axially spaced relation to one another;

first and second electrical contact elements disposed on each of the second sides of the respective first and second wall members, the first and second electrical contact elements on the second side of the first wall member being electrically engaged with the corresponding first and second electrical engaged with the corresponding first and second electrical contact elements on the second side of the second wall member; and means for electrically interconnecting the first and second electrical contact elements on the respective second sides of the first and second wall members through the respective first and second wall members to the respective first and second sets of insulated electrical conductors disposed in the aft and forward cartridge units.

17. The multi-cartridge unit ammunition round of claim 16 wherein the interconnecting means includes a plurality of electrically conductive rivets fastened through each of the first and second transverse wall members.

18. The multi-cartridge unit ammunition round of claim 16 wherein the first and second electrical contact elements on the second sides of the respective first and second transverse wall members are strips of conductive complementary material being detachably attachable together.

19. The multi-cartridge unit ammunition round of claim 18 wherein the first and second electrical contact elements on the second sides of the respective first and second transverse wall members are strips of aluminum foil.

20. The multi-cartridge unit ammunition round of claim 19 wherein the electrical interconnect interface also includes yieldably resilient material backing the aluminum foil strips of the first and second electrical contact elements on the second side of one of the first and second transverse wall members.

21. The multi-cartridge unit ammunition round of claim 14 wherein the first set of insulated electrical conductors includes:

a first insulated electrical conductor in the aft cartridge unit connected at one end to one of said plurality of primer electrodes of the primer and at an opposite end to the electrical interconnect interface disposed between the aft and forward cartridge units; and a second insulated electrical conductor in the aft cartridge unit connected at one end to the base of the art cartridge unit and at another end to the electrical interconnect interface disposed between the aft and forward cartridge units.

22. The multi-cartridge unit ammunition round of claim 14 further comprising:

additional sets of insulated electrical conductors disposed in any interim forward cartridge units and electrically connecting the primer with a corresponding electrical interconnect interface; and additional sets of insulated electrical conductors disposed in each additional forward cartridge unit and electrically connecting the respective interconnect interface with the respective electro-ignition device in the interim forward cartridge unit.

23. The multi-cartridge unit ammunition round of claim 14 wherein the cartridge units are readily separable and reconnectable and include means for detachably retaining the cartridge units in the tandem end-to-end arrangement.

24. The multi-cartridge unit ammunition round of claim 23 wherein the means for detachably retaining the independent cartridge units in the tandem end-to-end arrangement comprises snap-fitting mating means.

25. The multi-cartridge unit ammunition round of claim 24 wherein the snap-fitting mating means includes an annular exterior groove on one unit mated with an annular interior shoulder on the adjacent unit.

26. A multi-cartridge unit ammunition round including:

a plurality of independent, self-contained cartridge units having forward and aft ends configured to be nested in a tandem, coaxial arrangement;

detachable, reconnectable retaining means associated with the cartridge units whereby the independent cartridge units are capable of being disconnected and reconnected with each other in the round;

each said cartridge unit further comprising, means for carrying a propellant charge, electro-ignition means for igniting the propellant charge, the forward and aft ends including means cooperating to form a detachable, reconnectable electrical interconnect interface at each inter-cartridge unit junction such that ignition signals can be passed across each said junction to reach more forward electro-ignition means, and conductor means connecting the electro-ignition means with an associated said electrical interconnect interface.

27. The multi-cartridge unit ammunition round of claim 26 wherein the retaining means for detachably retaining the independent cartridge units in the tandem end-to-end arrangement comprises snap-fitting mating means.

28. The multi-cartridge unit ammunition round of claim 27 wherein the snap-fitting mating means includes an annular exterior groove on one unit mated with an annular interior shoulder on the adjacent unit.

29. The multi-cartridge unit ammunition round of claim 28 wherein the retaining means is easily engaged and disengaged such that number of intermediate units can be altered just prior to firing.

30. The multi-cartridge unit ammunition round of claim 28 wherein the cartridge units are essentially combustible.

* * * * *